US009427098B2

(12) United States Patent
Chowdhury et al.

(10) Patent No.: US 9,427,098 B2
(45) Date of Patent: Aug. 30, 2016

(54) SYSTEM AND METHOD FOR ROTATABLY MOUNTING A PICTURE FRAME

(71) Applicant: ART FORTH LLC, San Francisco, CA (US)

(72) Inventors: Rajib Chowdhury, San Francisco, CA (US); Parker Pruett, San Francisco, CA (US)

(73) Assignee: Art Forth LLC, San Francisco, CA (US)

( * ) Notice: Subject to any disclaimer, the term of this patent is extended or adjusted under 35 U.S.C. 154(b) by 0 days.

(21) Appl. No.: 14/668,631

(22) Filed: Mar. 25, 2015

(65) Prior Publication Data

US 2015/0272352 A1 Oct. 1, 2015

Related U.S. Application Data

(60) Provisional application No. 61/969,888, filed on Mar. 25, 2014.

(51) Int. Cl.
*A47G 1/16* (2006.01)
*A47G 1/06* (2006.01)

(52) U.S. Cl.
CPC ..... *A47G 1/166* (2013.01); *A47G 1/1613* (2013.01); *A47G 2001/0666* (2013.01); *A47G 2001/0688* (2013.01); *Y10T 29/49817* (2015.01); *Y10T 29/49826* (2015.01)

(58) Field of Classification Search
CPC ..... A47G 1/166; A47G 1/1613; A47G 2001/0666; A47G 2001/0688
USPC ..... 40/747
See application file for complete search history.

(56) References Cited

U.S. PATENT DOCUMENTS

| | | | | |
|---|---|---|---|---|
| 4,040,593 | A * | 8/1977 | Wiley | A47G 1/1606 248/479 |
| 4,750,282 | A | 6/1988 | Zennedjian | |
| 5,538,296 | A | 7/1996 | Horton | |
| 6,868,630 | B2 | 3/2005 | Kim | |
| 7,587,847 | B2 | 9/2009 | Lasher | |
| 7,654,026 | B2 | 2/2010 | Pitcher et al. | |
| 7,744,055 | B2 * | 6/2010 | Zeng | F16M 13/00 248/447 |
| 7,802,390 | B2 | 9/2010 | Reis | |

(Continued)

FOREIGN PATENT DOCUMENTS

GB 2425258 A 10/2006

*Primary Examiner* — Kristina Junge
(74) *Attorney, Agent, or Firm* — Kaplan Breyer Schwarz & Ottesen, LLP; Janine D. Geraigery, Esq.

(57) ABSTRACT

A mounting system and method for displaying viewable content on a supporting surface includes a frame assembly having a backing, a frame, means for securing viewable content between the backing and frame, and means for removing and replacing viewable content. The system includes a mount removable connected to the supporting surface and having an outer conduit having an inner surface, an aperture extending in a longitudinal direction, and a circumferential groove disposed within the inner surface. An anchor is integrally connected to the backing of the frame assembly and has a central axis. The anchor has an inner conduit and a spring-loaded pin having a longitudinal axis and configured to be inserted into the aperture of the outer conduit of the mount along the longitudinal direction. The system includes means for connecting the anchor and mount in a rotatable relationship about the central axis.

20 Claims, 10 Drawing Sheets

(56) References Cited

U.S. PATENT DOCUMENTS

| | | | | |
|---|---|---|---|---|
| 8,484,873 | B2 | 7/2013 | Splittgerber | |
| 2005/0223611 | A1* | 10/2005 | Dennis | A47G 1/065 40/729 |
| 2011/0138666 | A1 | 6/2011 | Borde et al. | |
| 2013/0097906 | A1 | 4/2013 | Schultz | |
| 2013/0160338 | A1 | 6/2013 | Forbis | |
| 2013/0247401 | A1 | 9/2013 | Miller | |

* cited by examiner

SYSTEM AND METHOD FOR ROTATABLY MOUNTING A PICTURE FRAME

CROSS-REFERENCES TO RELATED APPLICATIONS

This application claims the benefit of provisional patent application Ser. No. 61/969,888 filed in the United States Patent and Trademark Office on Mar. 25, 2014, the entire disclosure and drawings of which are incorporated by reference herein.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE EFS-WEB

Not applicable.

STATEMENT REGARDING PRIOR DISCLOSURES BY THE INVENTOR OR A JOINT INVENTOR

Not applicable.

SEQUENCE LISTING

Not applicable.

BACKGROUND OF THE INVENTION

1. Field of the Invention

This invention relates to devices for securing objects onto supporting surfaces, and more particularly, to a system and method for rotatably mounting a picture frame assembly to a wall surface for displaying decorative or functional objects or content.

2. Description of the Related Art

A picture frame is a structure that houses viewable content such as artwork or photographs for display purposes and/or to provide protection to the content. Although picture frames are often rectangular, they can come in a broad range of shapes and sizes, as well as materials. Picture frames are often mounted on a supporting surface such as a wall.

Typically, viewable content is placed within a picture frame by loading it through the back of the frame. To insert content, the frame backing is first unfastened. The backing is removed and content is inserted within the frame. The backing is then refastened and holds the content in place.

Frequent replacement of viewable content can degrade the durability of such picture frames over time. It may be necessary to detach the picture frame from a supporting surface to allow access to the back to change the content. Overtime, fasteners on the picture frame used to hold the backing and content in place can weaken or break. Furthermore, frequent replacement of content within a picture frame can damage the content itself.

To facilitate more convenient changing of viewable content, picture frames with front-loading processes have become more common in recent years. Snap-frames (U.S. Pat. No. 7,654,026) are an example of such framing systems, the entire disclosure of which is incorporated by reference herein.

There are a number of different ways to mount a picture frame to a supporting surface. For example, one common technique is to attach a bracket to the rear of the picture frame. The bracket is then hung on a supporting surface by using a fastener, such as a nail or hook. Another technique is to string a wire across the rear of the picture frame. The wire is then hung on a fastener that is connected to the supporting surface.

Such mounting systems reduce the advantages of front-loading picture frames. A front-loading process may obviate the need to remove the picture frame from the supporting surface to change the content. If the new content is to be viewed from a different orientation than the previous content such as horizontally or vertically, however, then the picture frame must still be removed from the supporting surface and reoriented appropriately.

It is a primary object of the present invention to provide a mounting system and method for rotatably connecting an object to a supporting structure for decoratively or functionally displaying objects or content.

It is another object of the present invention to provide a mounting system having means for connecting two interengageable parts, including a wall mount and object anchor, which allow for 360° rotation of the object about the wall mount.

It is another object of the present invention to provide a mounting system for displaying art, photography and documents within a frame assembly.

It is another objective of the present invention to provide a mounting system having a frame assembly capable of being loaded from the front or side for easily interchanging art, photography and documents while mounted to a wall surface.

It is another object of the present invention to provide a mounting system capable of easily adjusting the orientation of the object or frame assembly to any degree desired including, but not limited to, 45°, 90°, 135°, 180°, 360°.

It is another object of the present invention to provide a mounting system capable of providing a quick release for quickly separating the picture frame from the supporting surface.

It is another object of the present invention to provide a mounting system whereby the frame assembly can quickly and easily be rotated between a horizontal and vertical orientation while still being mounted on the wall surface.

BRIEF SUMMARY OF THE INVENTION

In accordance with one aspect of the present invention, a system for mounting a surface of an object to a supporting surface is provided. The system includes a mount having a base connected to the supporting surface. The mount has a female conduit having an inner surface and an aperture extending in a longitudinal direction. An anchor is integrally connected to the surface of the object. An anchor has a base integrally connected to the surface of the object. The anchor has a central axis, a male conduit extending outwardly from the base, a pin having a longitudinal axis extending from the male conduit and configured to be inserted into the aperture of the female conduit along the longitudinal direction. The system includes means for mating the conduits in a rotatable relationship.

The means for mating the conduits may include a ball bearing assembly disposed on an outer surface of the male conduit and a circumferential groove disposed in the inner surface of the female conduit, such that the ball bearings are adapted for being received within the groove of the female conduit for providing 360° rotation of the object about the central axis.

The object may be a side-loaded picture frame, front-loaded picture frame or snap frame.

The object may maintain its central axis while rotatable about the mount on the supporting surface.

In accordance with an additional embodiment a mounting system for displaying viewable content on a supporting surface is provided having a frame assembly including a backing, a frame, means for securing the viewable content between the backing and the frame, and means for removing and replacing viewable content. The system includes a mount removably connected to the supporting surface. The mount having an outer conduit having an inner surface, an aperture extending in a longitudinal direction, and a circumferential groove disposed within the inner surface of the outer conduit. The system includes an anchor integrally connected to the backing of the frame assembly. The anchor has a central axis. The anchor has an inner conduit and a spring-loaded pin having a longitudinal axis and extending from the inner conduit and configured to be inserted into the aperture of the outer conduit of the mount along the longitudinal direction. The system includes means for connecting the anchor and mount in a rotatable relationship about the central axis, wherein the backing of the frame assembly is proximate to the supporting surface.

The means for mating the conduits may include a ball bearing assembly disposed on the outer surface of the inner conduit and a circumferential groove disposed in the inner surface of the outer conduit, such that the ball bearings are adapted for being received within the groove of the outer conduit for providing 360° rotation of the frame assembly about the central axis.

The anchor may be adapted to secure the backing of the frame assembly to the mount about the central axis.

The spring-loaded pin of the outer conduit may be flush with the backing of the frame assembly when the anchor is connected to the mount.

The means for removing and replacing viewable content includes a side-loading frame, front-loading frame, or snap frame.

In accordance with an additional embodiment a mounting system is provided comprising a supporting surface, an object having a backing, and means for detachably connecting the backing of the object to the supporting surface. The connecting means comprising first and second interengageable parts, the first part being attached to one of the supporting surface and the backing of the object and comprising an inner male conduit having a spring-loaded pin extending outwardly in a longitudinal direction. The inner conduit comprises a ball bearing assembly. The second part being attached to the other of the surface and the object. The second part comprising an outer female conduit having an aperture and at least one circumferential groove correspondingly shaped with the ball bearing assembly, wherein the pin is adapted to be received within the aperture to connect the object and the surface in close proximity, wherein the interengageable parts connect in a rotatable relationship.

The supporting surface may be a wall. The object may be a picture frame. The picture frame may be from the group consisting of side-loading, front-loading and snap fitting. The connecting means may be a swivel joint.

In accordance with an additional embodiment a method of displaying viewable content within a frame assembly on a supporting surface is provided. The steps first comprise securing a base of a mount having a female conduit to the supporting surface. Then, providing a frame with a backing having an anchor integrated within the backing, and having a male conduit having a central axis. Next, connecting the anchor to the mount by mating the conduits in a rotatably relationship. Then, loading the viewable content between the backing and the frame, and rotating the frame about the central axis until a desired orientation is obtained.

The method may further comprise unloading viewable content from the frame, and reloading new viewable content within the frame while the anchor is secured to the mount.

BRIEF DESCRIPTION OF THE SEVERAL VIEWS OF THE DRAWINGS

To these and to such other objects that may hereinafter appear, the present invention relates to a system and method for rotatably mounting a picture frame assembly to a wall surface as described in detail in the following specification and recited in the annexed claims, taken together with the accompanying drawings, in which like numerals refer to like parts in which:

Figure 1:
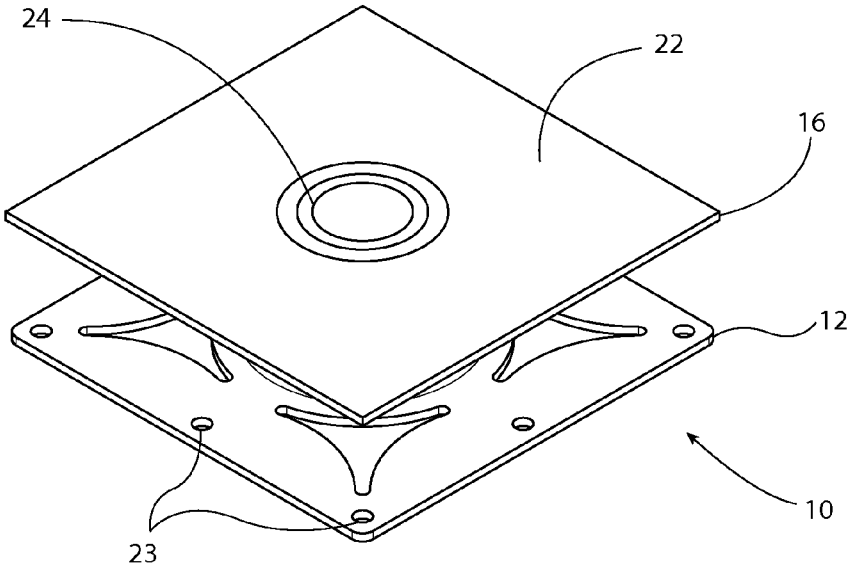
FIG. 1 is a perspective view of the front and top of a system for mounting an object to a supporting surface, showing first and second interengageable parts in accordance with the preferred embodiment of the present invention.
Figure 2:
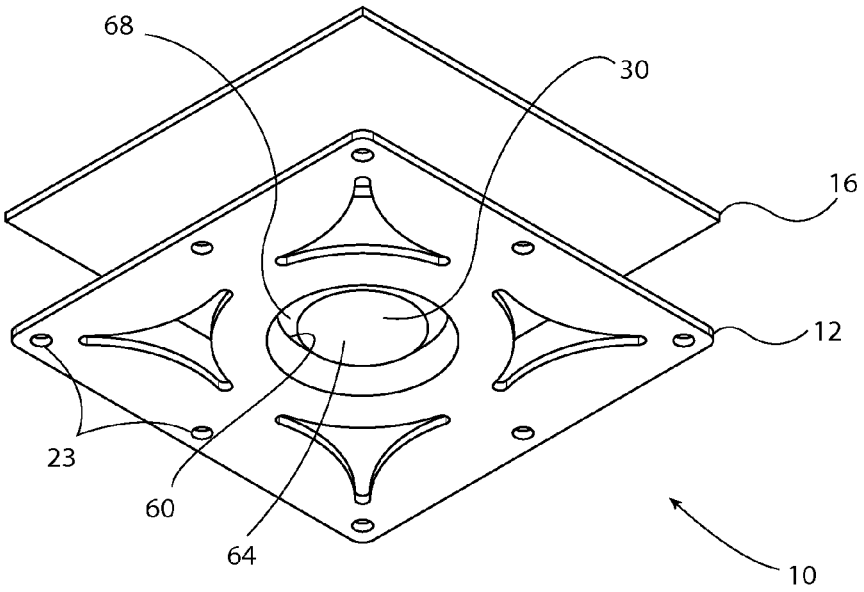
FIG. 2 is a perspective view of the front and bottom of the system for mounting an object to a supporting surface, showing first and second interengageable parts in accordance with the preferred embodiment of the present invention.
Figure 3:
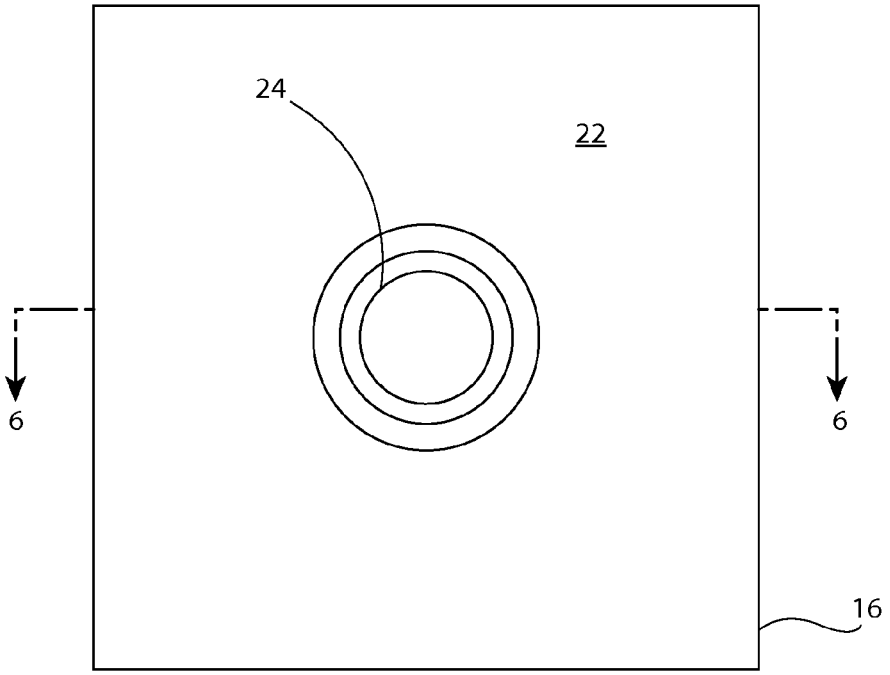
FIG. 3 is a plan view of the mounting system, showing the top of the second engageable part or object anchor.
Figure 4:
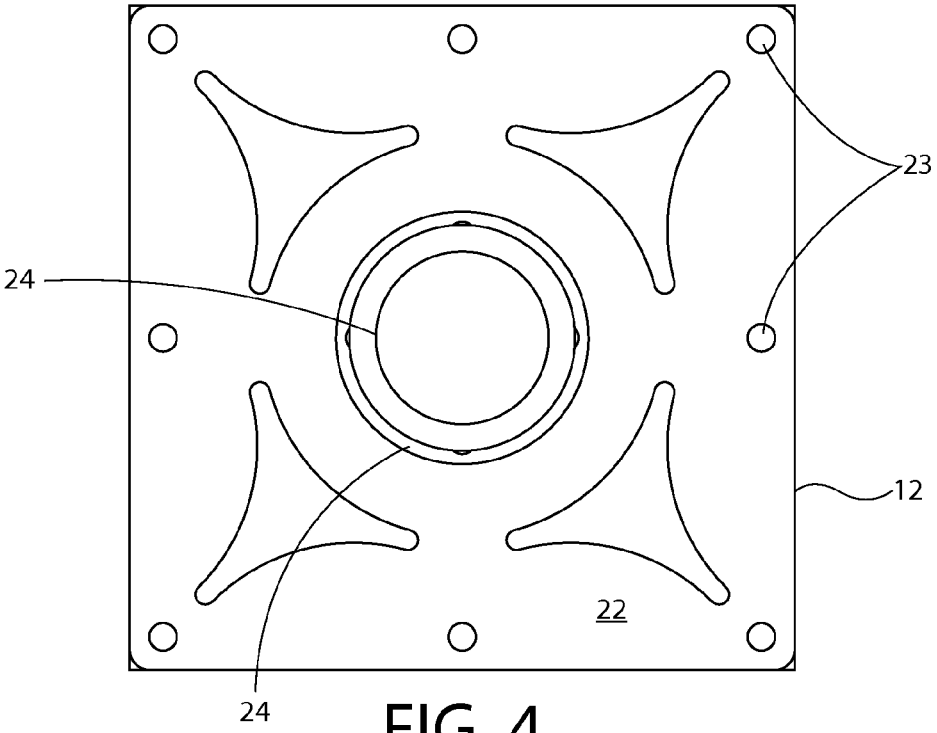
FIG. 4 is a plan view of the mounting system, showing the bottom of the first engageable part or wall mount.
Figure 5:
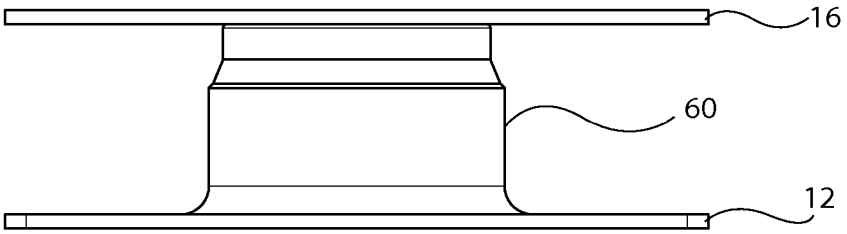
FIG. 5 is a side elevation view of the mounting system of FIG. 1.
Figure 6:
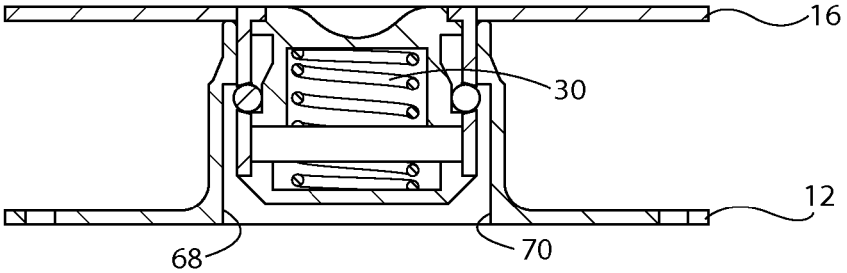
FIG. 6 is a cross-sectional view taken along line 6-6 of FIG. 3.
Figure 7:
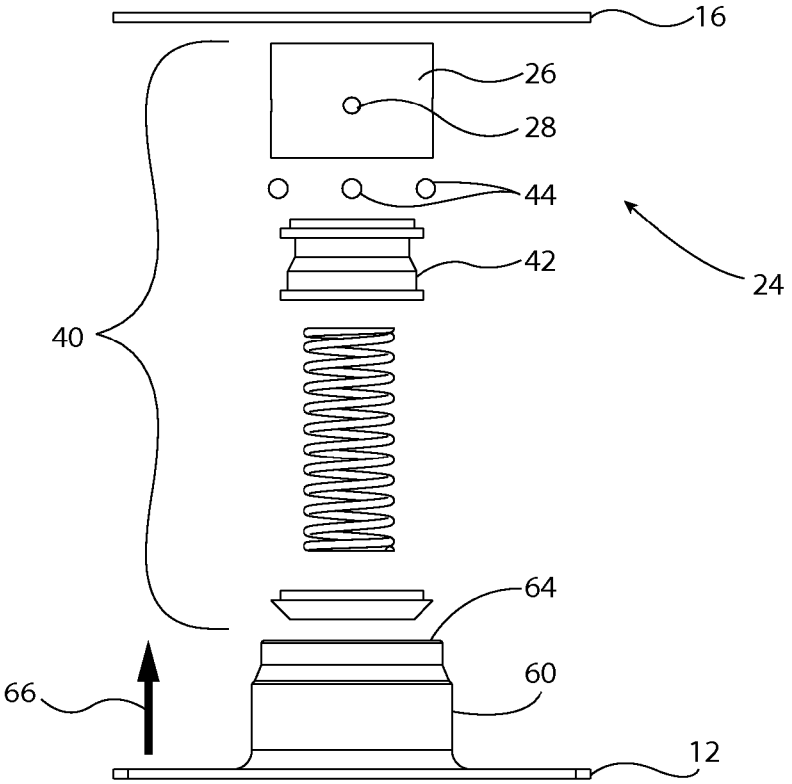
FIG. 7 is an exploded plan view of the mounting system of FIG. 1.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

DETAILED DESCRIPTION OF THE INVENTION

The present invention is a system and method for rotatably mounting an object to a supporting surface. In its broadest context, the mounting system 10 includes interengageable parts including a first engageable part 12 for attachment to a supporting surface 14, and a second engageable part 16 configured for attachment to an object 18.

In the present embodiment, illustrated in FIGS. 1-16, the first engageable part 12 is a wall mount and the second engageable part 16 is an object anchor. In alternate embodiments, the interengageable parts are interchangeable, such that first engageable part may be the object anchor attached to the object and the second engageable part may be the wall mount attached to the supporting surface.

FIGS. 1-7 illustrate the object anchor 16, which includes a central axis 20. The wall mount 12 and object anchor 16 interengageably connect, preferably via a swivel joint, to provide 360° rotation of the object 18 about the central axis 20 while preventing axial movement. In the preferred embodiment, the supporting surface 14 is a wall surface, and the object 18 is a frame assembly for displaying viewable content including art, photography, and documents.

Figure 8:
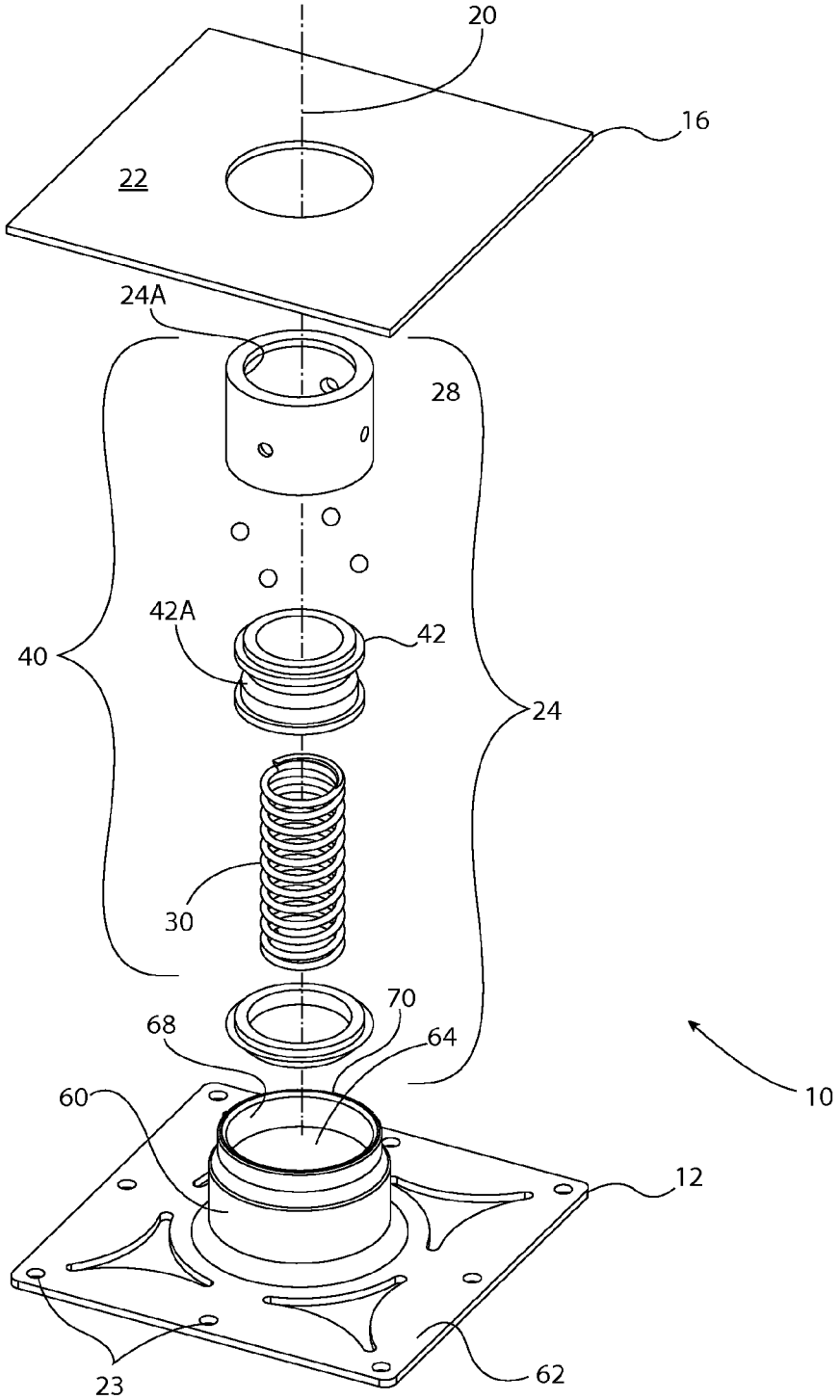
FIG. 8 is an exploded diagrammatic view of the mounting system of FIG. 1.
Figure 9:
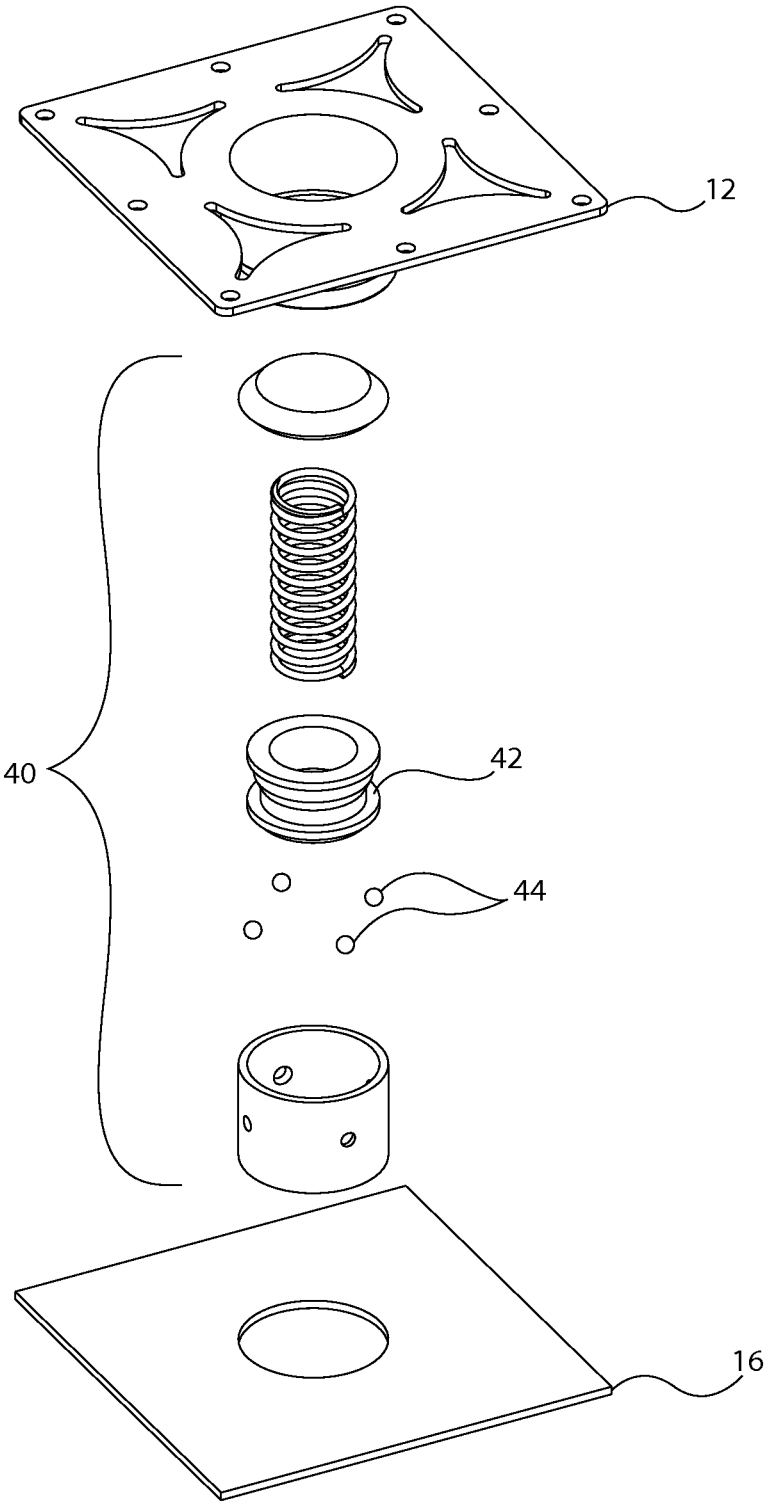
FIG. 9 is an exploded diagrammatic view of the mounting system of FIG. 1.

FIGS. 8 and 9 illustrate the wall mount 12, which includes an integrally connected tubular outer female conduit 60 connected to a base 62. The base 62 includes a plurality of holes 23 for connecting using a screw, nail, adhesive, other like fastener, the base to the wall surface, or in alternate embodiments the object. The outer conduit 60 includes an aperture 64, which extends in a longitudinal direction 66. The outer conduit 60 has an inner surface 68. A circumferential groove 70 is formed on the inner surface 68 of the outer conduit 60. The groove 70 is complimentary to the ball bearings 44 formed on the outer surface 26 of the inner conduit 24.

The object anchor 16 includes a base 22 and a tubular inner male conduit 24 extending outwardly from the base 22. The inner conduit 24 has an outer surface 26 having a plurality of openings 28. A spring-loaded pin 30 having a longitudinal axis 32 extends from the inner conduit 24. The inner conduit includes a ball bearing assembly 40 comprising a ring 42 and a plurality of spring-loaded ball bearings 44 adapted to be received through the holes 28 of the inner conduit 24 and held in position about a channel 42A defined by the ring 42 and inner surface 24A of the conduit 24. Preferably, the ball bearings 44 are oppositely or even spaced within the channel 42A about the inner conduit.

Figure 10:
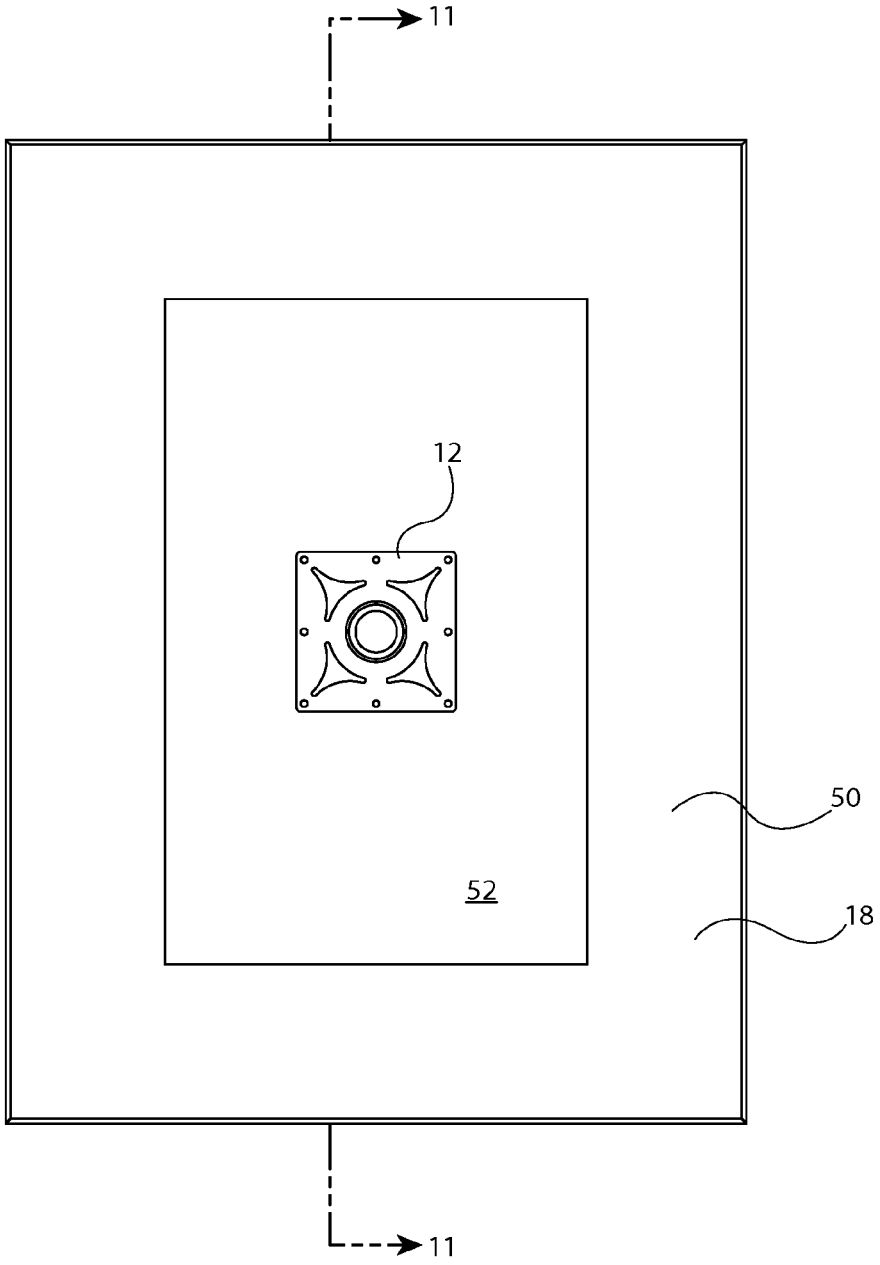
FIG. 10 is a plan view of the mounting system connected to a backing of a frame assembly in accordance with the preferred embodiment of the present invention.
Figure 11:
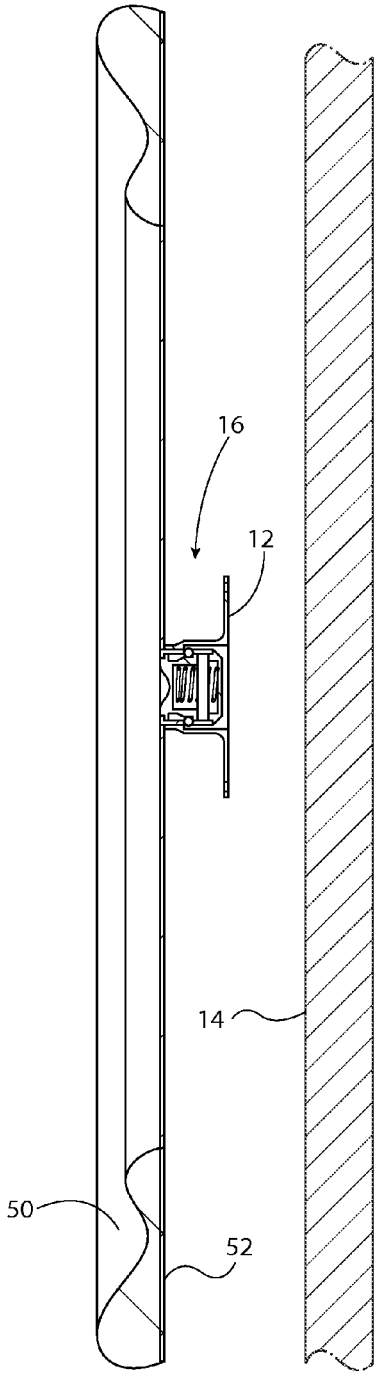
FIG. 11 is a cross-sectional view taken along line 11-11 of FIG. 10.
Figure 14:
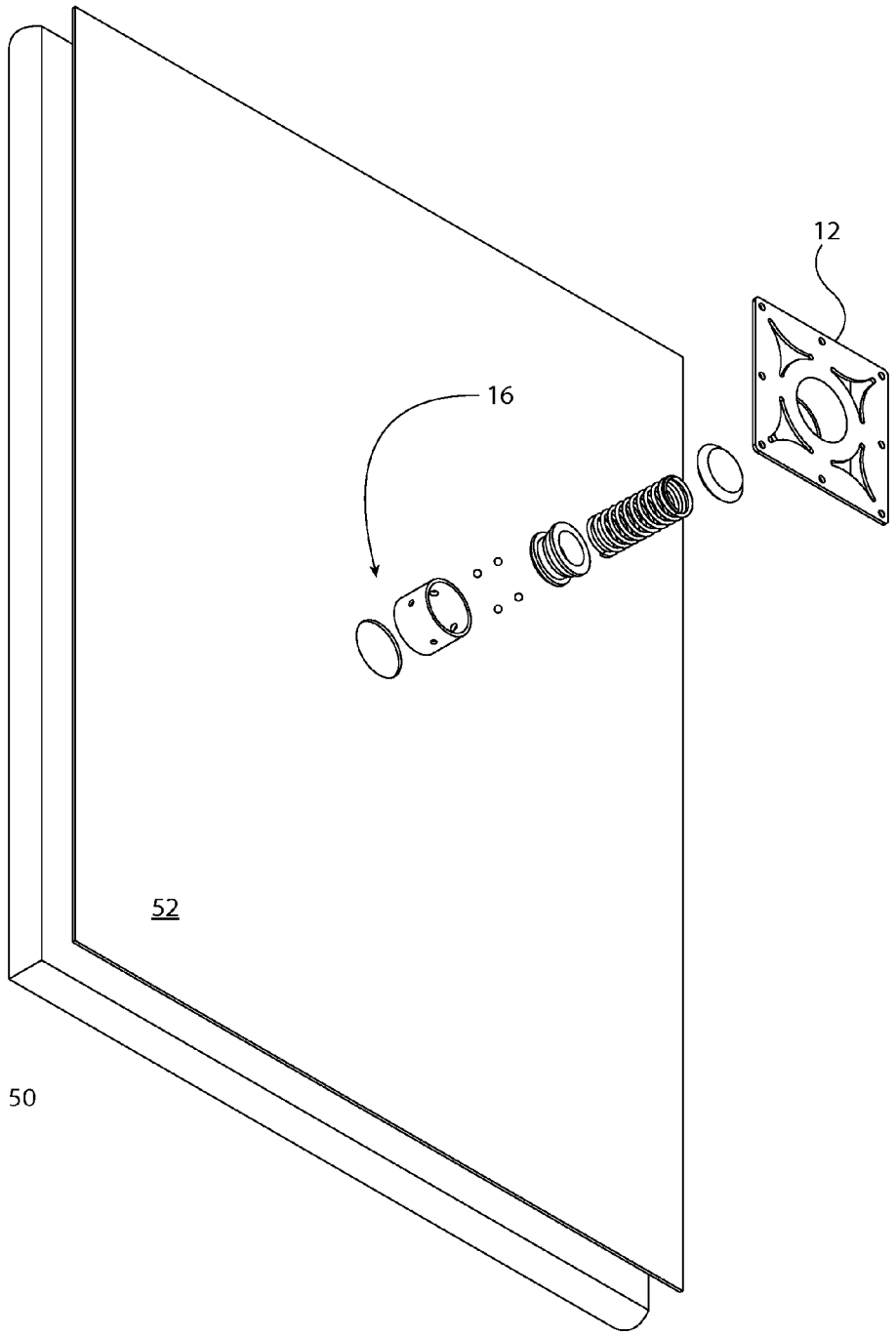
FIG. 14 is an exploded perspective view of the mounting system and frame assembly in accordance with the preferred embodiment of the present invention

FIGS. 10, 11 and 14 illustrate the object anchor 16 integrally coupled to the object 18. In the preferred embodiment, the object 18 is a frame assembly 50 having a backing 52. The object anchor 16 is integrally coupled within the backing 52 for providing 360° rotation of the assembly about the central axis 20 of the anchor. In other embodiments, the object anchor 16 may be integrated within the object at various other locations along a variety of alternate positions or axis's as selectively desired.

Figure 13:
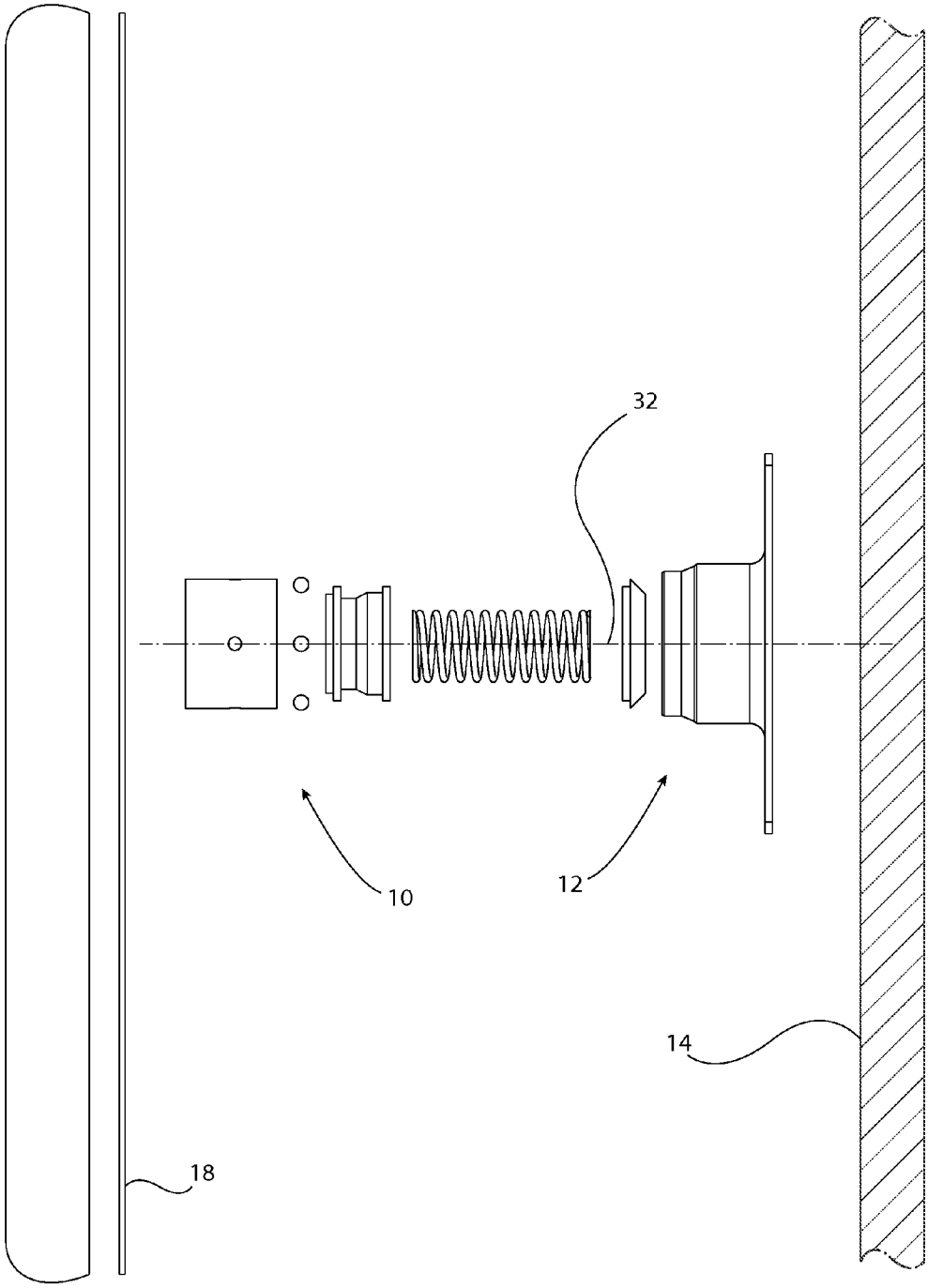
FIG. 13 is an exploded side view of the mounting system, frame assembly, and wall surface in accordance with the preferred embodiment of the present invention.

In the preferred embodiment, shown in FIG. 13, the object anchor 16 is integrated within the backing 52 of the assembly in a substantially flush manner, such that the backing of the assembly is substantially adjacent the wall surface when mounted.

Figure 12:
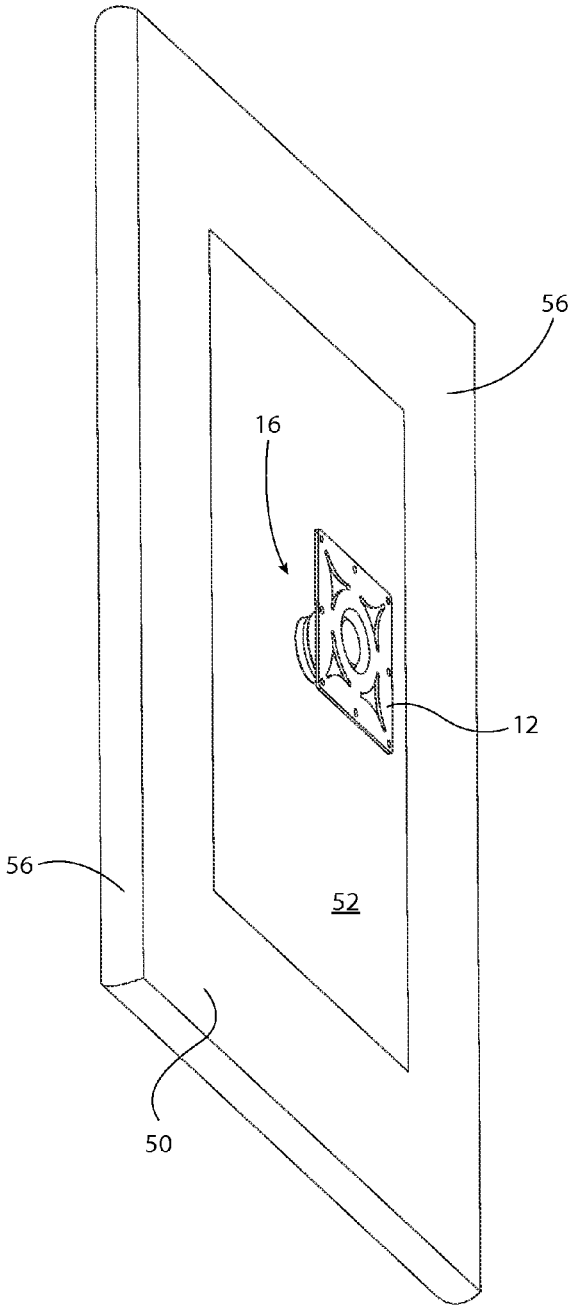
FIG. 12 is a perspective view of the mounting system connected to the backing of the frame assembly in accordance with the preferred embodiment of the present invention.

FIGS. 12-14 illustrate the system 10 in position for assembly, according to an exemplary embodiment, where the object anchor 16 is interengageably connected to the wall mount 12. First, the frame assembly 50 is positioned with the backing 52 of the frame 56 facing the wall surface 12. Next, the central axis 20 of the object anchor 16 is aligned with the outer conduit 60 of the wall mount 12. Then, the pin 30 of the inner conduit 24 is inserted within the aperture of the outer conduit 60, such that the inner and outer conduits 24, 60 begin to come together. The inner conduit 24 slides, snaps or fits partially within the outer conduit 60, stopped only by the outwardly extending ball bearings 44. Next, the pin 30 is depressed within the inner conduit 24, thereby retracting the ball bearings 44 within the holes 28 of the ball bearing assembly 40, such that the inner conduit 24 can fully slide into the outer conduit 60. Once the inner and outer conduits 24, 60 are completely coupled together, the ball bearings 44 are released to extend from the holes 28 and are received within the circumferential groove 70 of the outer conduit 60, and a snug and secure connection is obtained.

Figure 15:
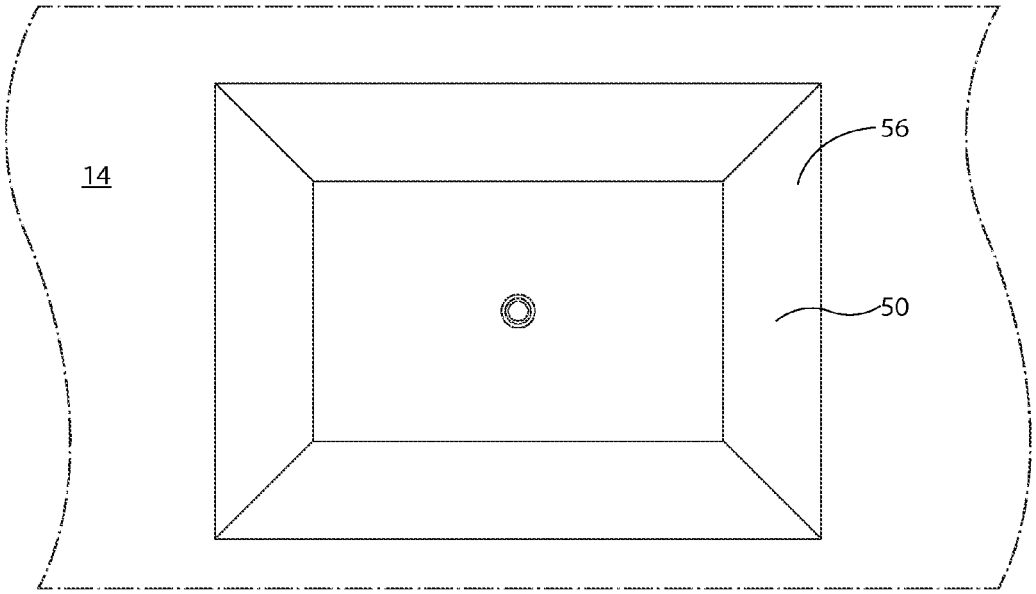
FIG. 15 is a front view of the frame assembly mounted to the wall surface via the mounting system for displaying content in a landscape orientation.
Figure 16:
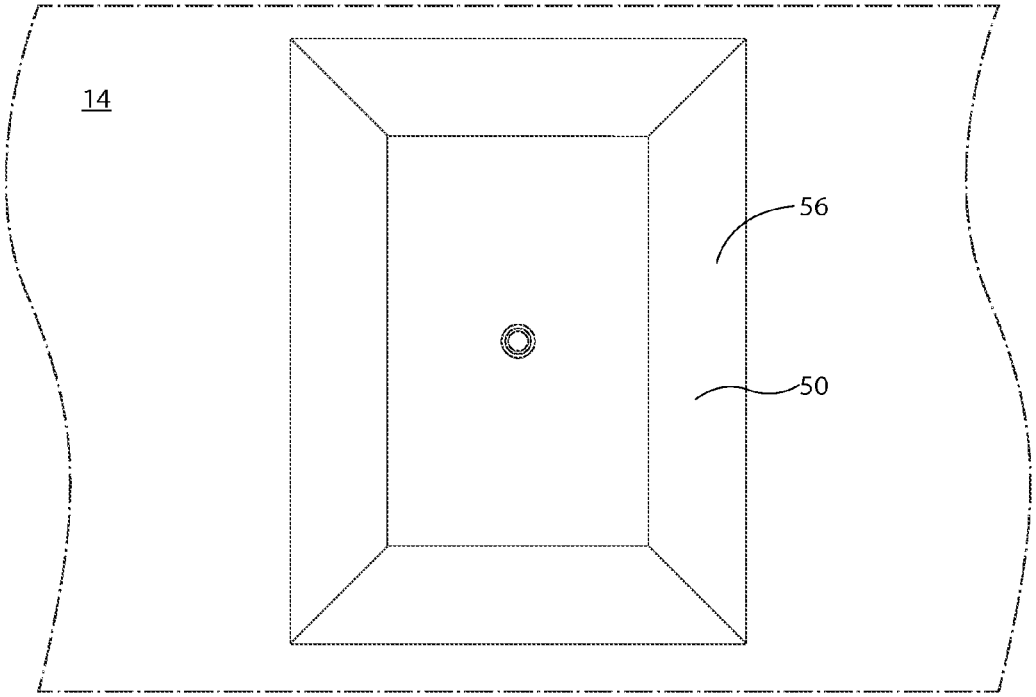
FIG. 16 is a front view of the frame assembly mounted to the wall surface via the mounting system for displaying content in a portrait orientation.

The frame assembly 50, illustrated in FIGS. 14-16, is then used to display viewable content including art, objects, items, photography, and documents. The framing assembly 50 includes a frame 56 that allows content to be loaded and unloaded via the front or side, while the assembly 50 remains mounted to the supporting or wall surface 14. In particular, the frame assembly 50 can be opened and content can be accessed by flipping open the perimeter of the frame 56. The orientation of the object or frame assembly 50 may be adjusted about the central axis 20 of the anchor 16, while the frame assembly 50 is mounted on the wall surface 14. This allows the frame assembly 50 to be rotated 360° so content may be viewed in varying orientations as desired (for example, 45°, 90°, 135°, 180°, 360°, etc.). FIG. 15 illustrates the frame assembly 50 in a landscape orientation, while FIG. 16 illustrates the frame assembly 50 in a portrait orientation.

To quickly release the object 18 from the wall surface 14, and disengage the inner and outer conduits 24, 60, the pin 30 is first depressed to retract the ball bearings 44 within the inner conduit 24. The outer conduit 60 is then able to disengage and come apart or slide off of the inner conduit 24.

The coupling of the anchor 16 and wall mount 12 in the present mounting system 10 uniquely allows the back of the object 18 to rest adjacent the wall surface without a void or other space, which is an inherent disadvantage with other mounting systems.

Various other connecting means are contemplated including means for connecting, attaching or adhering the conduits together.

It should be understood that numerous variations are possible, while adhering to the inventive concept. Such variations are contemplated as being a part of the present invention.

While only one preferred embodiment of the present invention has been disclosed for purposes of illustration, it is obvious that many modifications and variations could be made thereto. It is intended to cover all of those modifications and variations, which fall within the scope of the present invention as defined by the following claims.

We claim:

1. A system for mounting an object to a supporting surface, comprising:

a mount connected to the supporting surface, the mount having an aperture;

an anchor integrally connected to the object, the anchor having a male conduit extending outwardly therefrom, a single spring-loaded pin located interior the male conduit and configured to be inserted into the aperture of the mount; and means for mating the anchor to the mount in a rotatable relationship, wherein the mating means is located radially around the single spring-loaded pin.

2. The system of claim 1 wherein the means for mating the anchor to said mount includes a ball bearing assembly having a plurality of ball bearings disposed on an outer surface of the male conduit and a circumferential groove disposed in the aperture for receiving the ball bearings and for providing 360° rotation of the object about the support surface.

3. The system of claim 1 wherein the object is a side-loaded picture frame.

4. The system of claim 1 wherein the object is a front-loaded picture frame.

5. The system of claim 1 wherein the object is a snap frame.

6. The system of claim 1 wherein the object maintains a central axis while rotatable about the mount on the supporting surface.

7. A mounting system for displaying viewable content on a supporting surface, comprising:

a frame assembly including a backing and a frame for securing the viewable content between the backing and the frame;

an anchor integrally connected to the backing of the frame assembly, the anchor having an inner conduit and a single spring-loaded pin located interior the inner conduit;

a mount removably connected to the supporting surface, the mount having an outer conduit having an inner surface, and a circumferential groove disposed within the inner surface, a ball bearing assembly having a plurality of ball bearings located radially around the single spring-loaded pin for rotatably connecting the inner conduit of the anchor to the outer conduit of the mount, such that the plurality of ball bearings are received within the circumferential groove of the outer conduit.

8. The mounting system of claim 7 wherein the ball bearing assembly provides 360° rotation of the frame assembly about the supporting surface.

9. The mounting system of claim 7 wherein the anchor is adapted to secure the backing of the frame assembly to the mount about the central axis.

10. The mounting system of claim 7 wherein the outer conduit is flush with the backing of the frame assembly when the anchor is connected to the mount.

11. The mounting system of claim 7 wherein the frame assembly is a side-loading frame.

12. The mounting system of claim 7 wherein the frame assembly is a front-loading frame.

13. The mounting system of claim 7 wherein the frame assembly is a snap frame.

14. A mounting system, comprising a supporting surface, an object having a backing, and means for detachably connecting the backing of the object to the supporting surface, the connecting means comprising first and second interengageable parts, the first part being attached to one of the supporting surface and the backing of the object and comprising an inner male conduit having a single spring-loaded pin extending outwardly in a longitudinal direction, the inner conduit comprising a ball bearing assembly, the second part being attached to the other of the surface and the object, the second part comprising an outer female conduit having an aperture and at least one circumferential groove correspondingly shaped with the ball bearing assembly, wherein the single spring-loaded pin is adapted to be received within the aperture such that the ball bearing assembly is located radially around the spring-loaded pin to connect the object and the surface in close proximity, wherein the interengageable parts connect in a rotatable relationship.

15. The mounting system of claim 14 wherein the supporting surface is a wall.

16. The mounting system of claim 14 wherein the object is a picture frame.

17. The mounting system of claim 16 wherein the picture frame is from the group consisting of side-loading, front-loading and snap fitting.

18. The mounting system of claim 14 wherein the connecting means is a swivel joint.

19. A method of displaying viewable content within a frame assembly on a supporting surface, the steps comprising:

securing a base of a mount having a female conduit to the supporting surface;

providing a frame with a backing having an anchor integrated within the backing, the anchor having a male conduit, a single spring-loaded pin located interior the male conduit, and a ball bearing assembly located radially around the single spring-loaded pin;

connecting the anchor to the mount by mating the male and female conduits in a rotatable relationship;

loading the viewable content between the backing and the frame; and rotating the frame about the central axis relative to the base to a desired orientation and maintaining the frame in the desired position via the conduits.

20. The method of claim 19 further comprising unloading viewable content from the frame, and reloading new viewable content within the frame while the anchor is secured to the mount.

* * * * *